US006431091B1

(12) United States Patent
Chang

(10) Patent No.: US 6,431,091 B1
(45) Date of Patent: Aug. 13, 2002

(54) FOLDABLE WORK TABLE

(76) Inventor: Chao Tang Chang, No. 426, Derhuah Street, Taichung City (TW)

( * ) Notice: Subject to any disclaimer, the term of this patent is extended or adjusted under 35 U.S.C. 154(b) by 0 days.

(21) Appl. No.: 09/773,030

(22) Filed: Jan. 30, 2001

(51) Int. Cl.[7] ..... A47B 3/00
(52) U.S. Cl. ..... 108/115
(58) Field of Search ..... 108/115, 69, 77, 108/78, 79, 80, 120

(56) References Cited

U.S. PATENT DOCUMENTS 59,974 A * 11/1866 Cutler
D144,590 S * 4/1946 Schutes
3,415,208 A * 12/1968 Thoresen et al.
5,119,741 A * 6/1992 Pencoske ..... 108/115 X
5,363,613 A * 11/1994 Sevier ..... 108/115 X
5,403,082 A * 4/1995 Kramer ..... 108/115 X
6,053,116 A * 4/2000 Jung et al. ..... 108/115

* cited by examiner

*Primary Examiner*—Jose V. Chen
(74) *Attorney, Agent, or Firm*—Pro Techtor International Services

(57) ABSTRACT

A foldable worktable comprises a structural member including a central leaf, a left support board, and a parallel right support board, a hinged left drop-leaf a hinged right drop-leaf, a hinged first support including a first front leg, a first rear leg, and a first cross bar, a hinged second support including a second front leg, a second rear leg, and a second cross bar, a hinged first side bar, a hinged second side bar, a hinged inclined first strut, and a hinged inclined second strut. An extension table and rollers may be provided for increasing working space and movability.

4 Claims, 9 Drawing Sheets

FOLDABLE WORK TABLE

FIELD OF THE INVENTION

The present invention relates to worktable and more particularly to a foldable worktable with improved characteristics.

BACKGROUND OF THE INVENTION

A conventional worktable such as a bench saw is a fixed structure wherein a circular saw is mounted thereon. Such conventional worktable is unsatisfactory for the purpose for which the invention is concerned because it is not foldable. As a result, it is inconvenient to move such worktable. In some extreme cases such as a working position on a room of a high rise building, it is even impossible to move it from the first floor. Thus improvement exists.

SUMMARY OF THE INVENTION

It is an object of the present invention to provide a foldable worktable comprising a structural member including a central leaf, a left support board, and a parallel right support board both extended down from said central leaf; a left drop-leaf pivotably coupled to said left side of said central leaf by a first swingable joint; a right drop-leaf pivotably coupled to said right side of said central leaf by a second swingable joint; a first support including a first front leg, a first rear leg, and a first cross bar wherein said top of said first front leg is pivotably coupled to said left side of said left drop-leaf by a third swingable joint, said top of said first rear leg is pivotably coupled to said left side of said left drop-leaf by a fourth swingable joint, and said first cross bar is fixed between said lower parts of said first front leg and said first rear leg; a second support including a second front leg, a second rear leg, and a second cross bar wherein said top of said second front leg is pivotably coupled to said right side of said right drop-leaf by a fifth swingable joint, said top of said second rear leg is pivotably coupled to said right side of said right drop-leaf by a sixth swingable joint, and said second cross bar is fixed between said lower parts of said second front leg and said second rear leg; a first side bar having said right end pivotably coupled to said left side of said lower part of said left support board by a seventh swingable joint and said left end threadedly secured to said first cross bar by a first fastener; a second side bar having said left end pivotably coupled to said right side of said lower part of said right support board by a eighth swingable joint and said right end threadedly secured to said second cross bar by a second fastener; an inclined first strut having said right end pivotably coupled to said upper part of said left support board by a ninth swingable joint and said left end fixed to said external end of said first side bar; and an inclined second strut having left end pivotably coupled to said upper part of said right support board by a tenth swingable joint and said right end fixed to said external end of said second side bar.

In one aspect of the present invention, an extension table is provided at said underside of said right drop-leaf, said extension table including a first tube, a spaced second tube both at said bottom of said right drop-leaf, a first bar slidable in said first tube, a second bar slidable in said second tube, a connection bar fixed to said external ends of said first and said second bars, and a pair of third fasteners at said undersides of said first and said second tubes respectively wherein said third fasteners are operable to threadedly secure said first and said second bars to said first and said second tubes respectively.

In another aspect of the present invention, there is provided a pair of rollers on said bottoms of said external sides of said left support board and said right support board respectively.

The above and other objects, features and advantages of the present invention will become apparent from the following detailed description taken with the accompanying drawings.

DETAILED DESCRIPTION OF THE PREFERRED EMBODIMENTS

Figure 1:
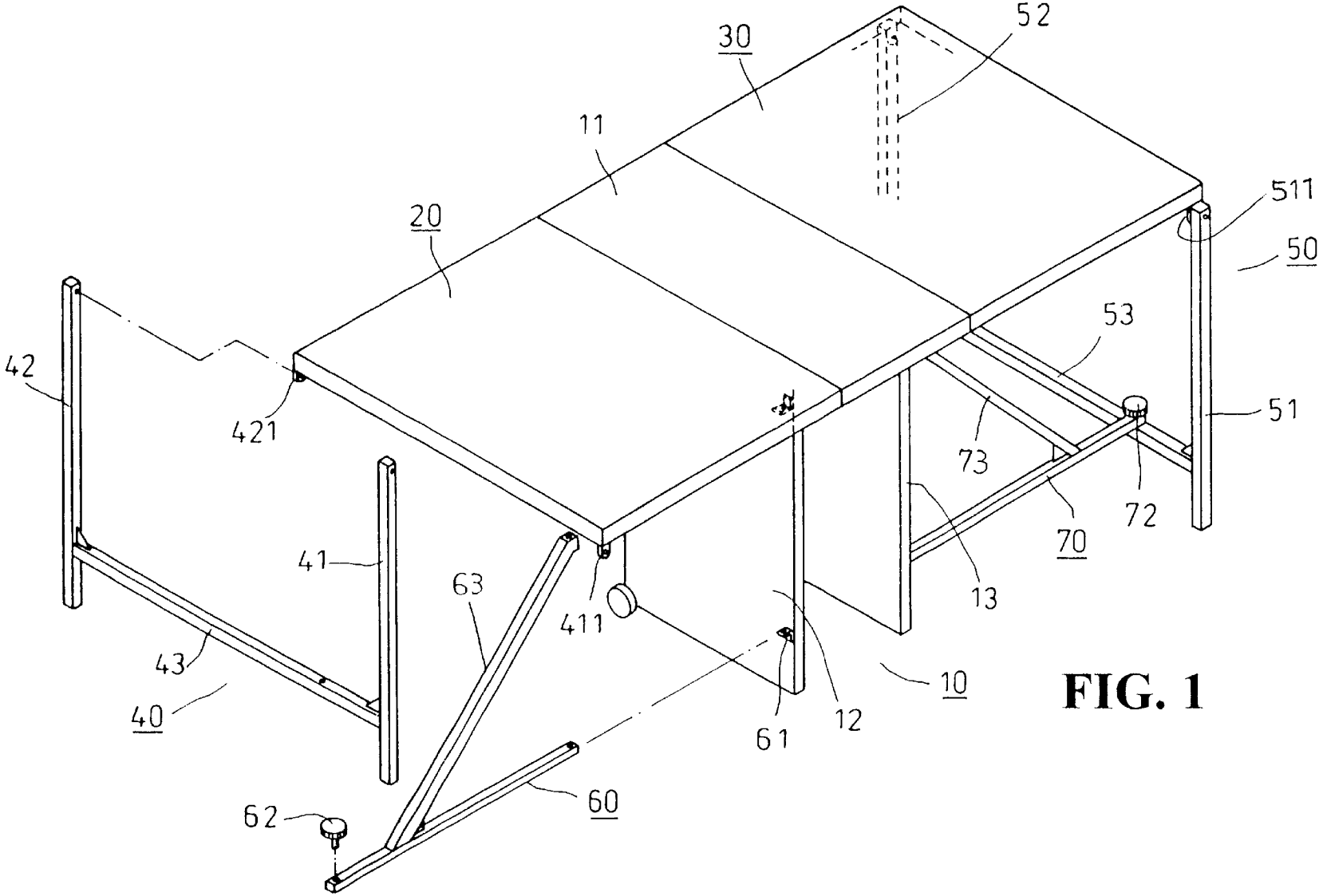
FIG. 1 is an exploded perspective view of a first preferred embodiment of foldable worktable according to the invention.
Figure 2:
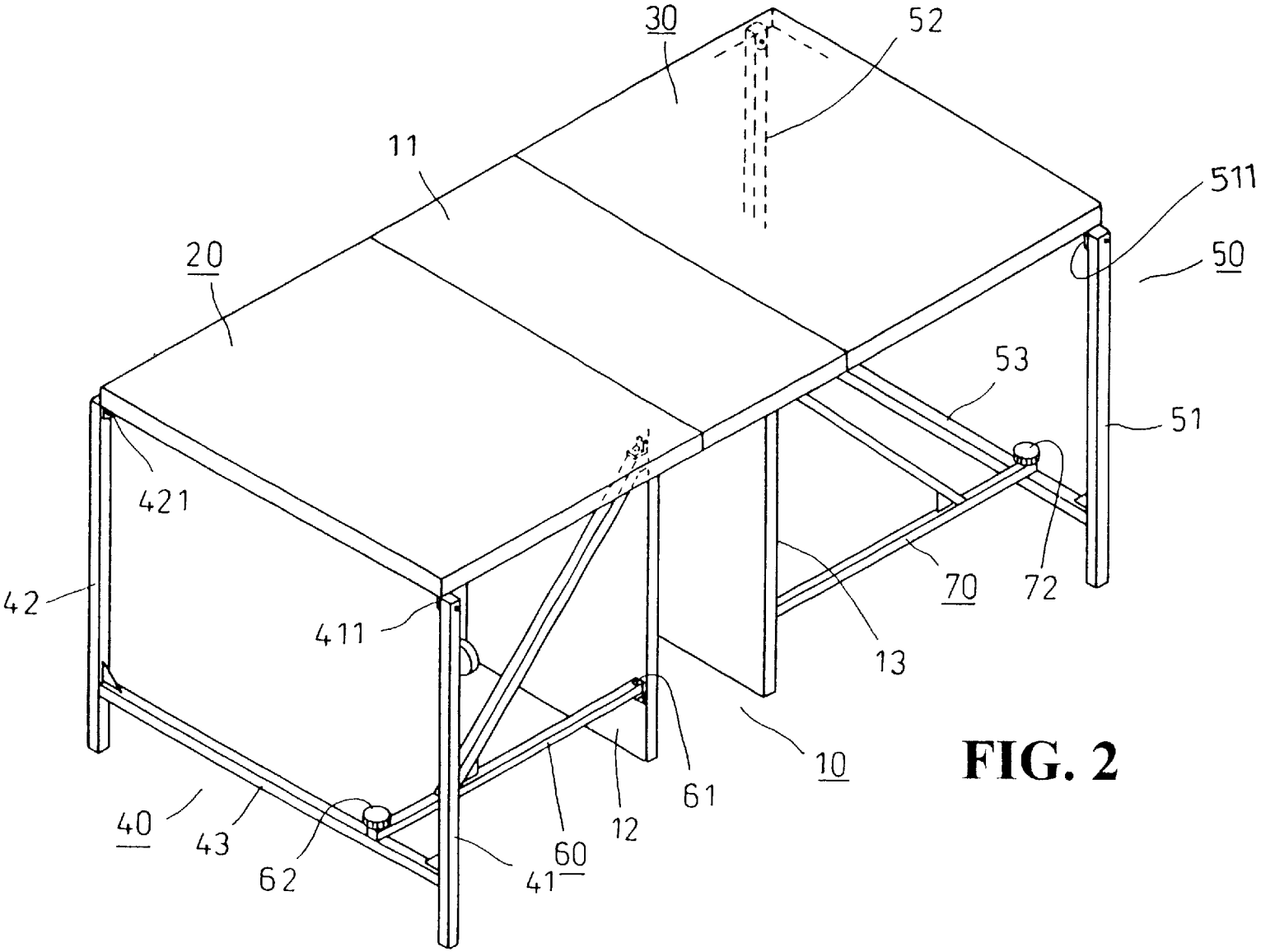
FIG. 2 is a perspective view of the assembled FIG. 1 worktable.
Figure 3:
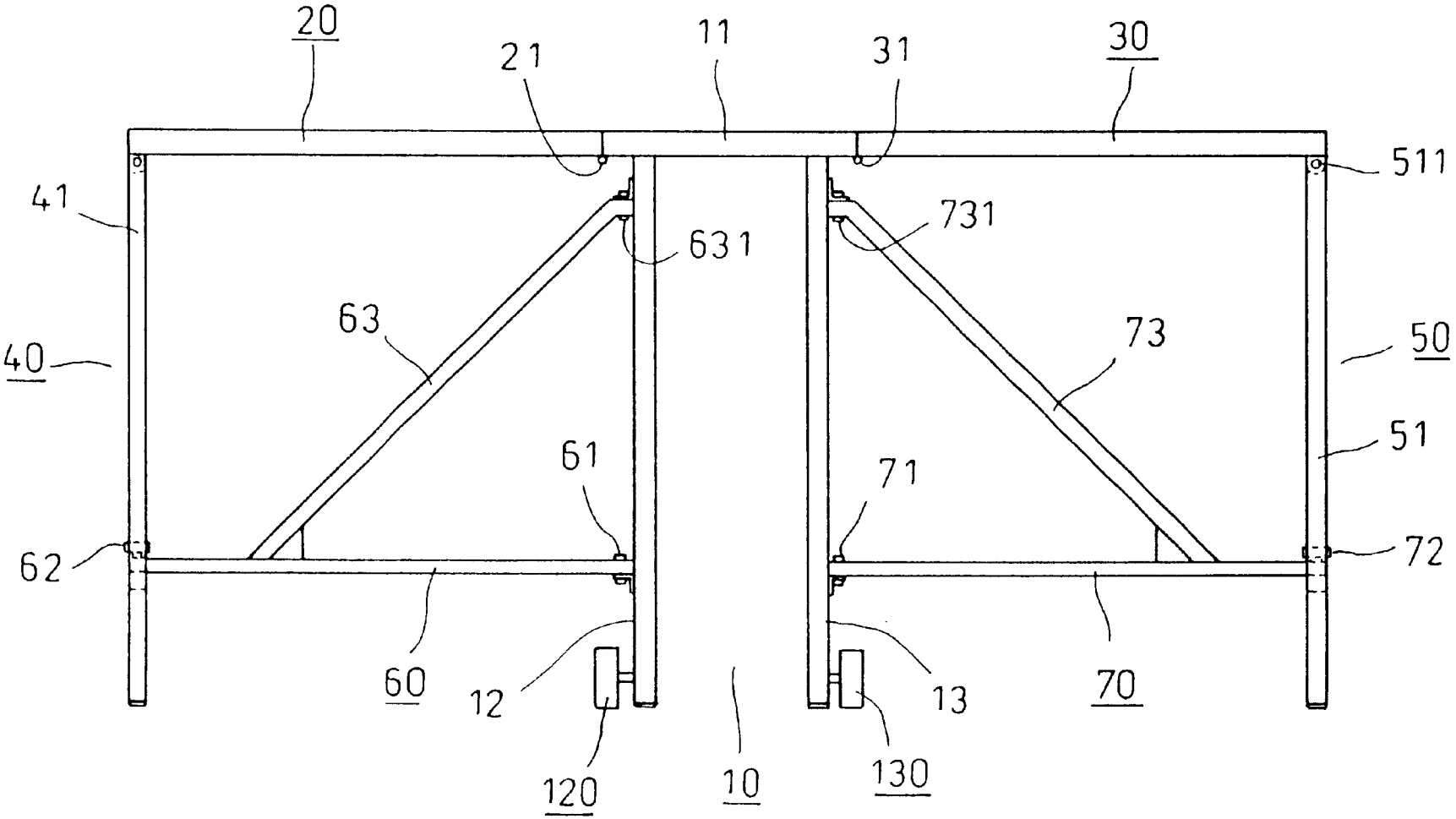
FIG. 3 is a side view of FIG. 2.

Referring to FIGS. 1 to 3, there is shown a first embodiment of foldable worktable constructed in accordance with the invention. The foldable worktable comprises a structural member 10 including a central leaf 11, a left support board 12, and a parallel right support board 13 both extended down from the central leaf 11; a left drop-leaf 20 pivotably coupled to the left side of central leaf 11 by a first swingable joint 21; a right drop-leaf 30 pivotably coupled to the right side of central leaf 11 by a second swingable joint 31; a first support 40 including a first front leg 41, a first rear leg 42, and a first cross bar 43 wherein the top of the first front leg 41 is pivotably coupled to the left side of left drop-leaf 20 by a third swingable joint 411, the top of the first rear leg 42 is pivotably coupled to the left side of left drop-leaf 20 by a fourth swingable joint 421, and the first cross bar 43 is fixed between the lower parts of the first front leg 41 and the first rear leg 42; a second support 50 including a second front leg 51, a second rear leg 52, and a second cross bar 53 wherein the top of the second front leg 51 is pivotably coupled to the right side of right drop-leaf 30 by a fifth swingable joint 511, the top of the second rear leg 52 is pivotably coupled to the right side of right drop-leaf 30 by a sixth swingable joint 521, and the second cross bar 53 is fixed between the lower parts of the second front leg 51 and the second rear leg 52; a first side bar 60 having right end pivotably coupled to the left side of the lower part of the left support board 12 by a seventh swingable joint 61 and the left end threadedly secured to the first cross bar 43 by a first fastener 62; a second side bar 70 having left end pivotably coupled to the right side of the lower part of the right support board 13 by a eighth swingable joint 71 and right end threadedly secured to the second cross bar 53 by a second fastener 72; an inclined first strut 63 having right end pivotably coupled to the upper part of the left support board 12 by a ninth swingable joint 631 and left end fixed to the external end of the first side bar 60; an inclined second strut 73 having left end pivotably coupled to the upper part of the right support board 13 by a tenth swingable joint 731 and right end fixed to the external end of the second side bar 70; and a pair of rollers 120 and 130 on the bottoms of the external sides of the left support board 12 and right support board 13 respectively.

Figure 4:
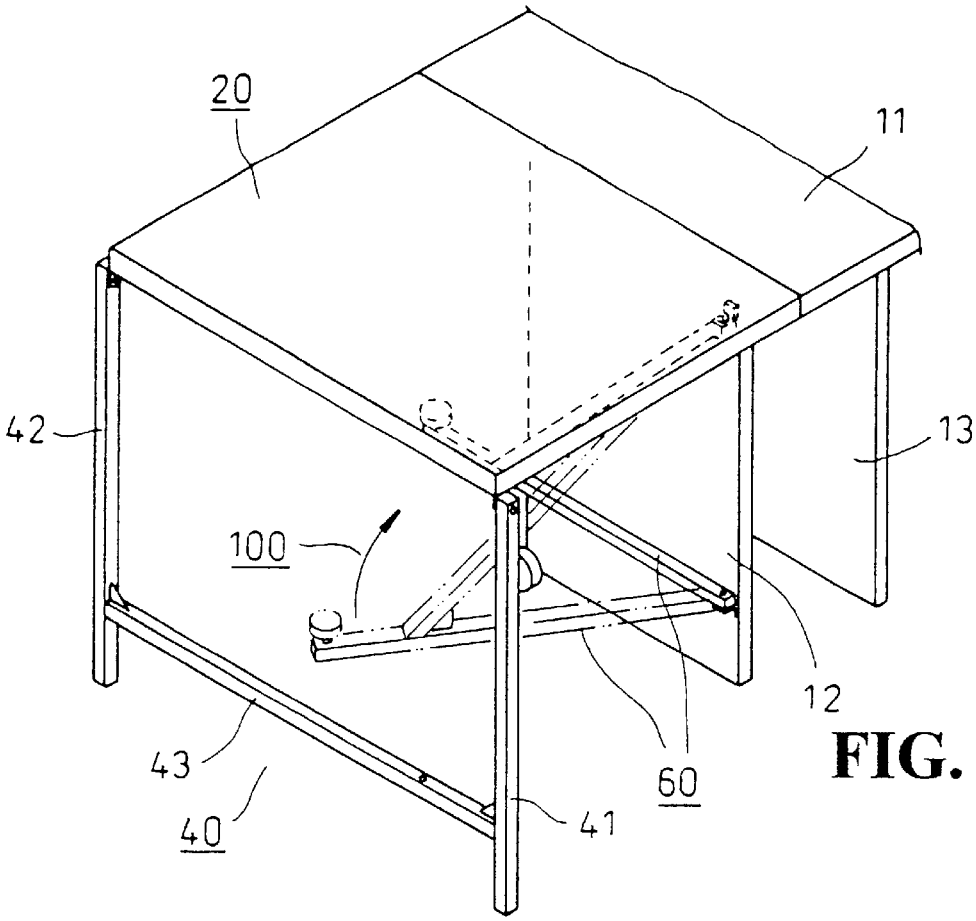
FIG. 4 is a fragmentary view of FIG. 2 illustrating the folding of a first side bar.
Figure 7:
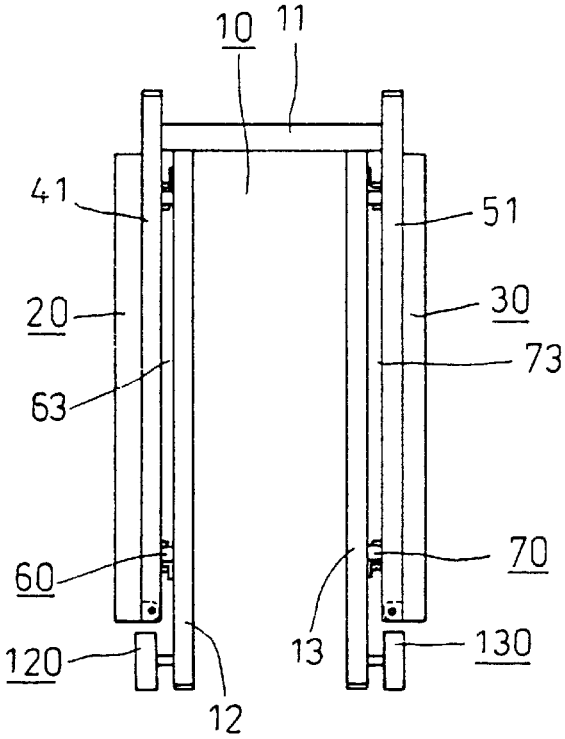
FIG. 7 is a side view of the fully folded worktable shown in FIG. 2.
Figure 5:
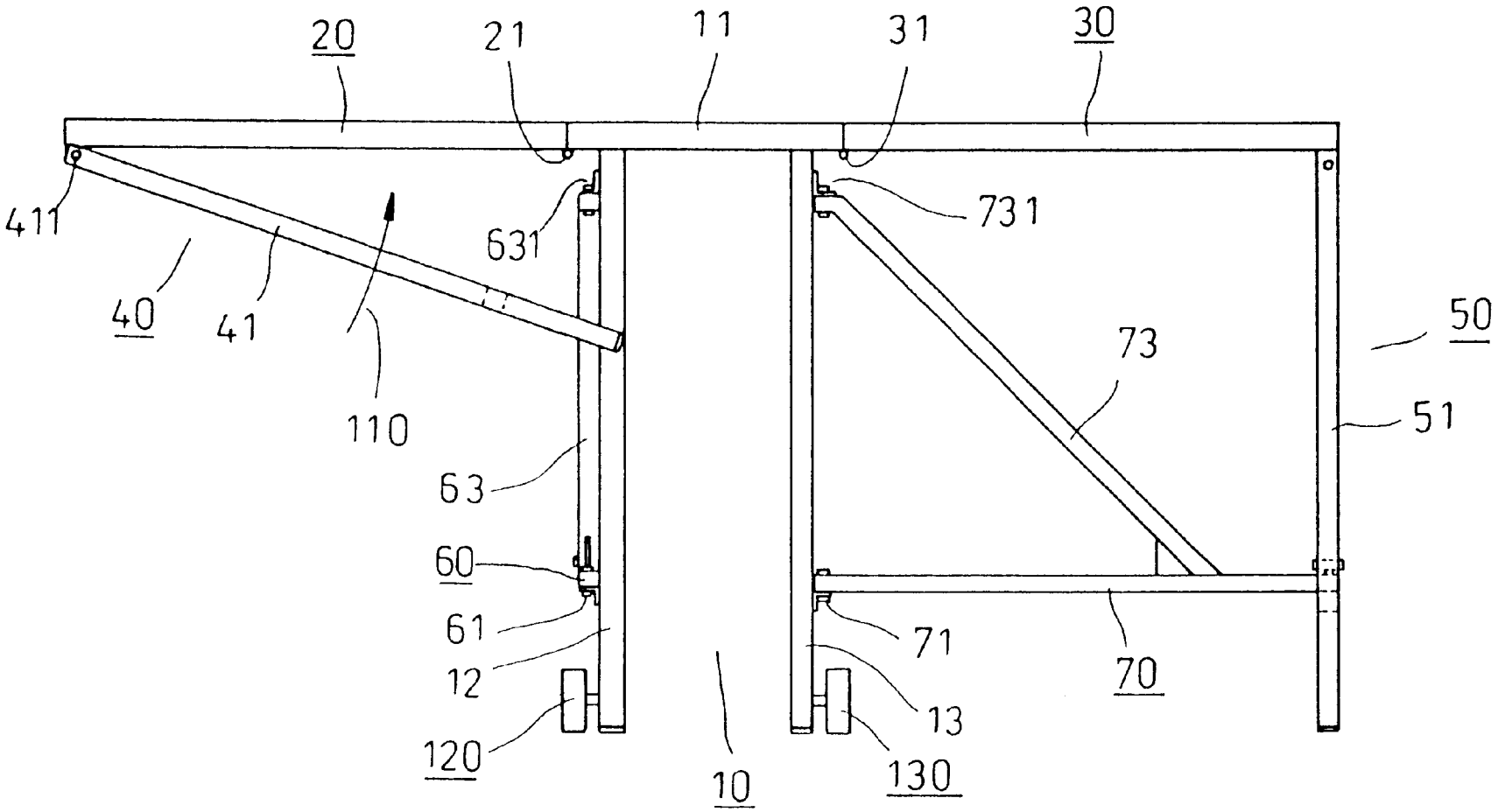
FIG. 5 is a side view showing a folded first support.
Figure 6:
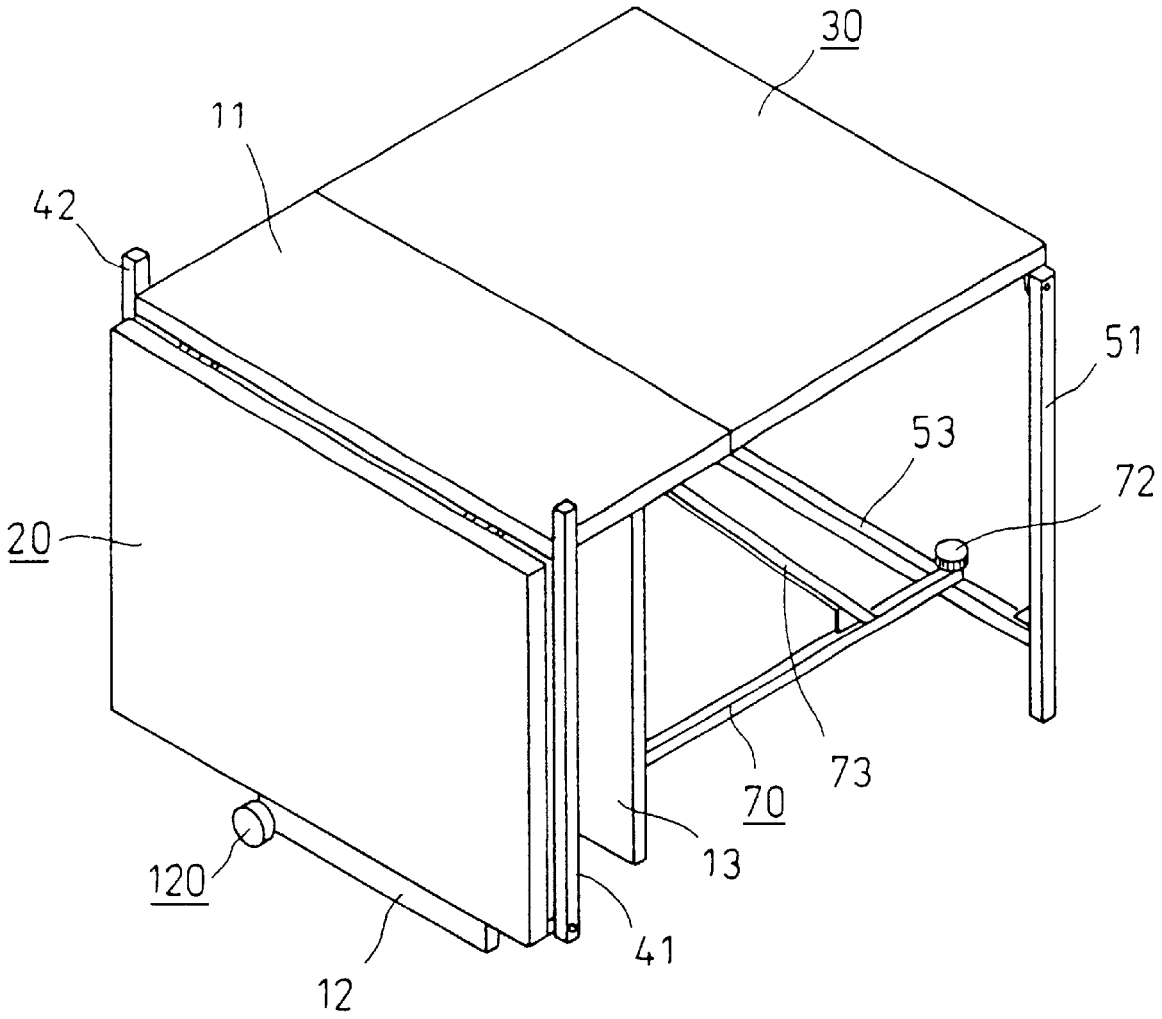
FIG. 6 is a perspective view showing a folded left drop-leaf.

Referring to FIGS. 4 to 7, a detailed description of the folding operation of the worktable is as follows. First unscrew first fastener 62. Then pivot the first side bar 60 toward left support board 12 about seventh swingable joint 62 as indicated by arrow 100 until engaged with left support board 12 (FIG. 4). Next pivot the first support 40 upward about third and fourth swingable joints 411 and 421 as indicated by arrow 110 until engaged with the bottom of left drop-leaf 20 (FIG. 5). Next pivot the left drop-leaf 20 downward about first swingable joint 21 as shown in FIG. 6. Likewise, repeat above operations to fold the second side bar 70, the second support 50, and right drop-leaf 13. A fully folded worktable is shown in FIG. 7. At this state, the worktable is convenient to move by the rollers 120 and 130.

Figure 8:
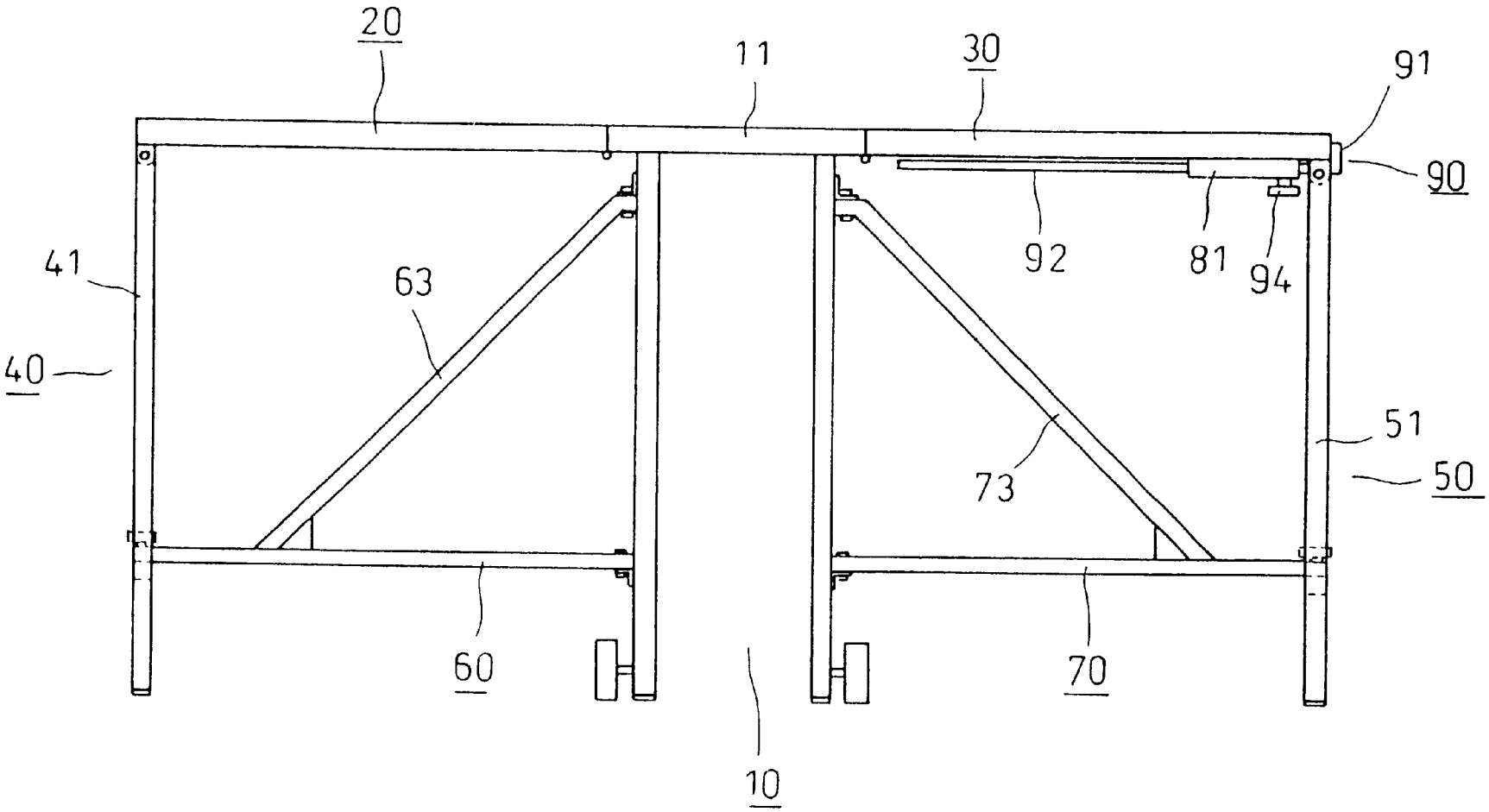
FIG. 8 is a side view of a second preferred embodiment of foldable worktable according to the invention.
Figure 9:
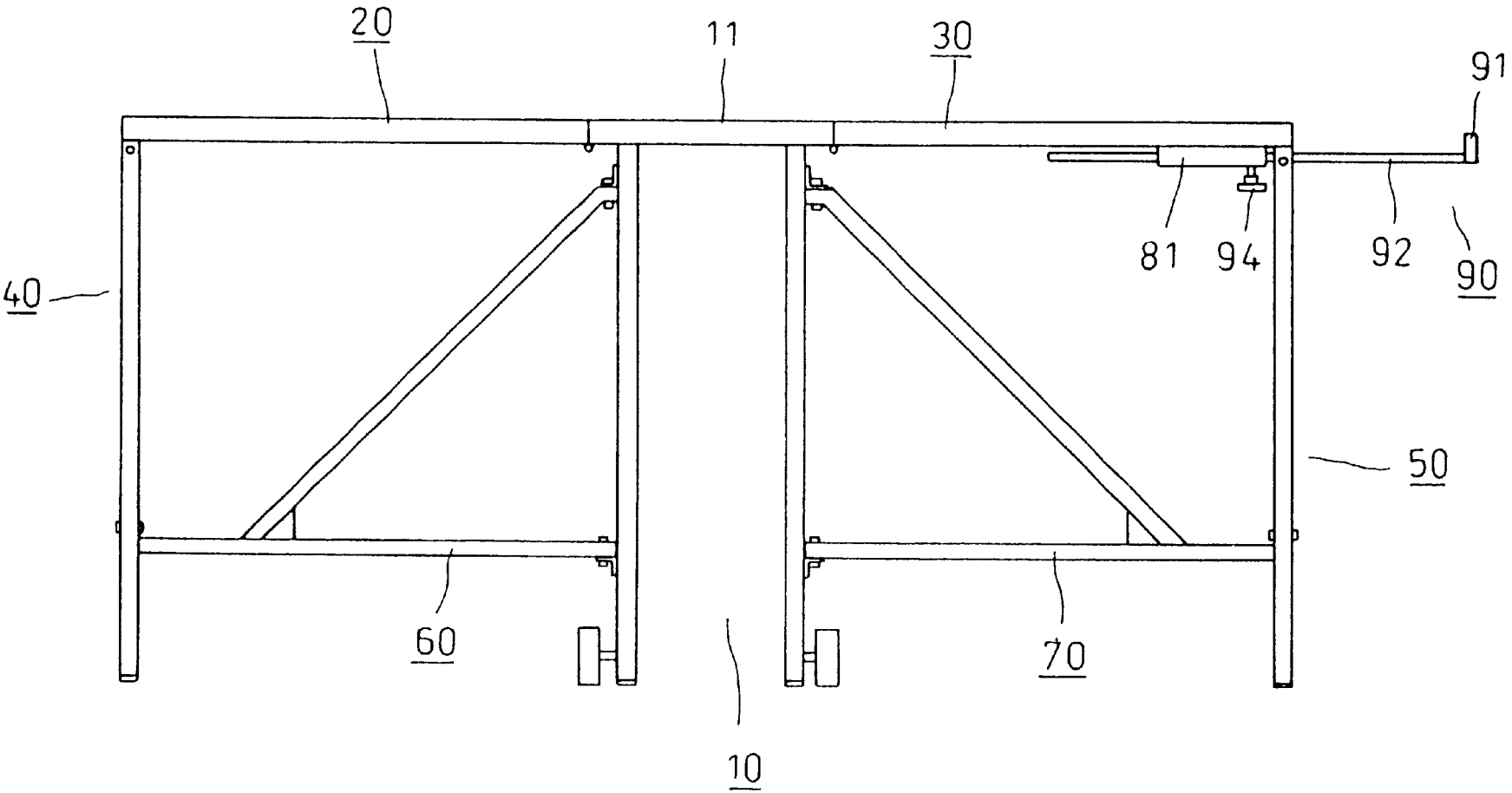
FIG. 9 is a view similar to FIG. 8 where extension table is partially extended.
Figure 10:
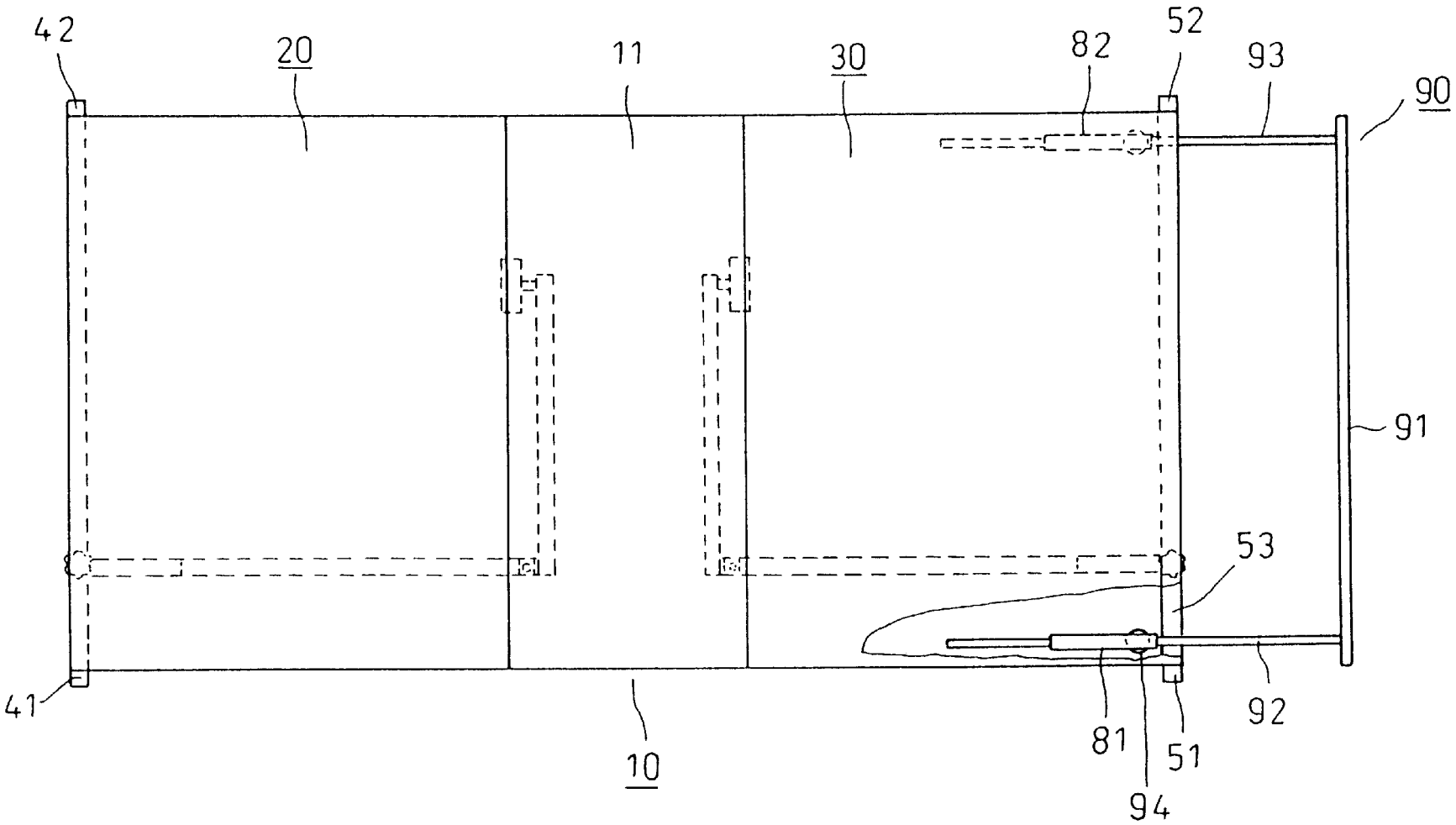
FIG. 10 is a top plan view of FIG. 9 with a portion broken away to reveal the interior features.

Referring to FIGS. 8 to 10, a second preferred embodiment of foldable worktable according to the invention is shown. The difference between second and first preferred embodiments is that an extension table 90 is provided at the second preferred embodiment as detailed below. Extension table 90 is at the underside of right drop-leaf 13. A first tube 81 and a second tube 82 are provided on two sides at the underside of right drop-leaf 13 respectively. Extension table 90 comprises a first bar 92 slidable in first tube 81, a second bar 93 slidable in second tube 82, a connection bar 91 fixed to the external ends of the first and second bars 92 and 93, and a pair of fasteners 94 at the undersides of first and second tubes 81 and 82 respectively. Fasteners 94 are operable to threadedly secure first and second bars 92 and 93 to first and second tubes 81 and 82 respectively when extension table 90 has been pulled to a desired length or completely retracted under right drop-leaf 13 in a storage position.

While the invention has been described by means of specific embodiments, numerous modifications and variations could be made thereto by those skilled in the art without departing from the scope and spirit of the invention set forth in the claims.

What is claimed is:

1. A foldable worktable comprising:

a structural member including a central leaf, a left support board, and a right support board both extended down from said central leaf;

a left drop-leaf pivotably coupled to a left side of said central leaf by a first swingable joint;

a right drop-leaf pivotably coupled to a right side of said central leaf by a second swingable joint;

a first support including a first front leg, a first rear leg, and a first cross bar wherein a top of said first front leg is pivotably coupled to a left side of said left drop-leaf by a third swingable joint, a top of said first rear leg is pivotably coupled to said left side of said left drop-leaf by a fourth swingable joint, and said first cross bar is fixed between lower parts of said first front leg and said first rear leg;

a second support including a second front leg, a second rear leg and a second cross bar wherein a top of said second front leg is pivotably coupled to a right side of said right drop-leaf by a fifth swingable joint, a top of said second rear leg is pivotably coupled to said right side of said right drop-leaf by a sixth swingable joint, and said second cross bar is fixed between lower parts of said second front leg and said second rear leg;

a first side bar having an end pivotably coupled to a left side of a lower part of said left support board by a seventh swingable joint and said end threadedly secured to said first cross bar by a first fastener;

a second side bar having a first end pivotably coupled to a right side of a lower part of said right support board by an eighth swingable joint and a second end threadedly secured to said second cross bar by a second fastener;

an inclined first strut having a right end pivotably coupled to an upper part of said left support board by a ninth swingable joint and a left end fixed to an external end of said first side bar; and an inclined second strut having a left end pivotably coupled to an upper part of said right support board by a tenth swingable joint and a right end fixed to an external end of said second side bar.

2. The foldable worktable of claim 1, further comprising an extension table at an underside of said right drop-leaf, said extension table including a first tube and a second tube both at a bottom of said right drop-leaf, a first bar slidable in said first tube, a second bar slidable in said second tube, a connection bar fixed to said external ends of said first and said second bars, and a pair of third fasteners at undersides of said first and said second tubes respectively, wherein said third fasteners are operable to threadedly secure said first and said second bars to said first and said second tubes respectively.

3. The foldable worktable of claim 2, further comprising rollers on bottoms of external sides of said left support board and said right support board respectively.

4. The foldable worktable of claim 1, further comprising rollers on bottoms of external sides of said left support board and said right support board respectively.

* * * * *